United States Patent [19]

Dogliotti

[11] 4,264,629

[45] Apr. 28, 1981

[54] PACKAGE FOR A SWEETMEAT PRODUCT

[75] Inventor: Amilcare Dogliotti, Alba, Italy

[73] Assignee: P. Ferrero & C. S. p. A., Alba, Italy

[21] Appl. No.: 54,370

[22] Filed: Jul. 3, 1979

[30] Foreign Application Priority Data

Dec. 21, 1978 [IT] Italy ..... 53987/78[U]

[51] Int. Cl.[3] ..... B65D 85/60

[52] U.S. Cl. ..... 426/115; 206/45.33; 206/45.34; 229/87 F; 229/DIG. 13; 426/124

[58] Field of Search ..... 209/87 F, DIG. 13, 87 R; 426/124, 115; 206/45.33, 45.34

[56] References Cited

U.S. PATENT DOCUMENTS

| | | | |
|---|---|---|---|
| 2,752,037 | 6/1956 | Vogt | 426/115 |
| 2,890,122 | 6/1959 | Katon | 426/115 |
| 3,249,214 | 5/1966 | Aust | 426/106 |
| 3,355,082 | 11/1967 | Wood | 426/115 |
| 3,446,416 | 5/1969 | Epstein | 229/87 F |
| 3,575,337 | 4/1971 | Bernhardt | 229/87 F |
| 3,610,512 | 10/1971 | Hermann | 229/DIG. 13 |
| 3,730,739 | 5/1973 | Seiferth et al. | 206/461 |
| 3,964,669 | 6/1976 | Sontag et al. | 229/87 F |
| 4,070,489 | 1/1978 | Pahnke | 426/124 |
| 4,106,621 | 8/1978 | Sorenson | 206/470 |
| 4,189,054 | 2/1980 | Llu et al. | 229/2.5 R |

FOREIGN PATENT DOCUMENTS

| | | | |
|---|---|---|---|
| 703450 | 2/1965 | Canada | 206/470 |
| 495572 | 11/1938 | United Kingdom | 426/115 |

*Primary Examiner*—Steven L. Weinstein

*Attorney, Agent, or Firm*—Sughrue, Rothwell, Mion, Zinn & Macpeak

[57] ABSTRACT

A package for a sticky sweetmeat product avoids contact with the consumer's fingers, when the product is being eaten, by having a base with a part which folds down to facilitate consumption, and two side panels for gripping the product when a transparent plastics cap is removed. The package is sealed within a flexible wrapper.

5 Claims, 5 Drawing Figures

PACKAGE FOR A SWEETMEAT PRODUCT

The present invention relates to packages for sweetmeat products, particularly sweetmeat products having planar surfaces.

It is well known that, when unwrapping a conventionally-packaged sweetmeat product, the consumer has to handle the sweetmeat directly, and this handling often leaves the consumer's fingers unpleasantly sticky. The object of the present invention is to provide a sweetmeat package which, in addition to having a protective function, will enable the consumer to hold the product, take it to the mouth and consume it without once handling the sweetmeat directly.

According to the present invention there is provided a package for a sweetmeat product having a planar surface, characterised in that the package comprises a planar base element which cooperates with the planar surface of the sweetmeat product, and has a respective side panel upstanding from each of its sides, and a transverse folding zone, a plastics cap which abuts the base element enclosing the sweetmeat product, each side panel abutting a respective outer surface of the cap, and a flexible wrapper which encloses the package.

The packaging according to the invention enables a consumer, after removing the wrapper, to hold the product between the side panels without actually handling the sweetmeat itself. The package is, therefore, both hygenic and convenient, since it prevents soiling of the consumer's hands by a sticky product.

One embodiment of the invention will now be more particulary described, by way of example, with reference to the accompanying drawings, in which.

Figure 1:
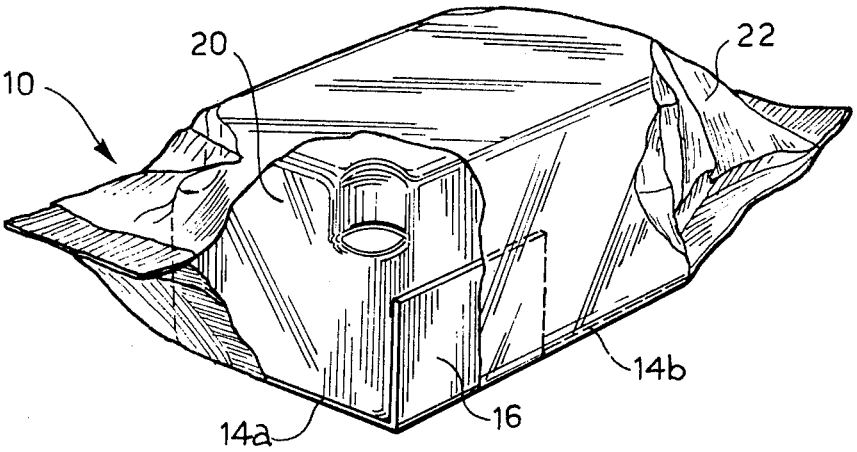
FIG. 1 is a partly cut-away perspective view of a package for a sweetmeat product according to the present invention.
Figure 2:
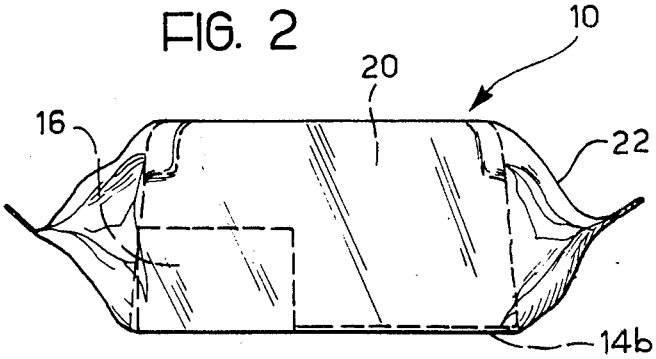
FIG. 2 is a side elevational view of the package of FIG. 1.
Figure 3:
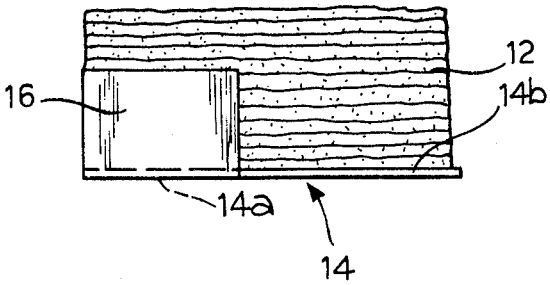
FIG. 3 is a side elevational view of the package of FIG. 2 with its wrapper removed.
Figure 4:
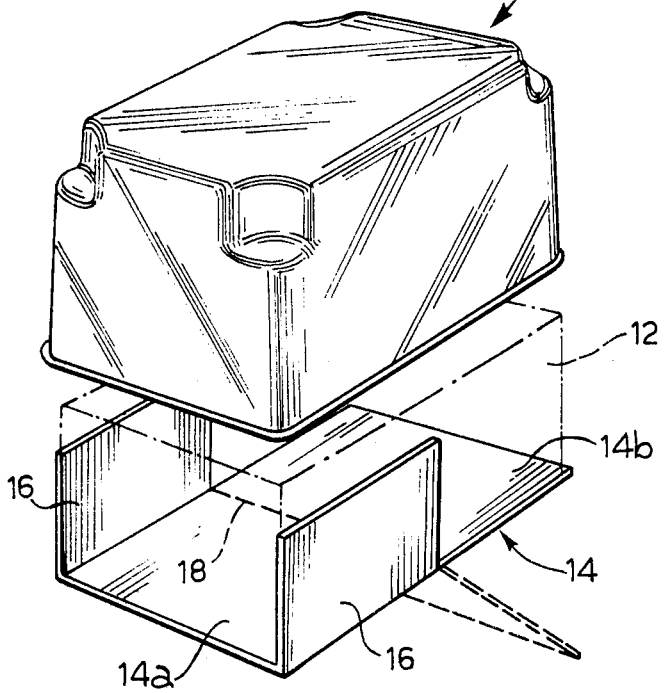
FIG. 4 is an exploded perspective view of the package of FIG. 3.

Referring now to the drawings, there is shown a package, generally indicated 10, containing a sweetmeat product 12, such as, for example, a fondant, fudge, candy or cake, which has a planar elongate base surface. In the example shown, the sweetmeat 12 has a parallelipiped shape, but it may have, for example, a prismatic shape. The sweetmeat 12 is received by a planar base element 14 made from cardboard in a rectangular shape, the base surface of the sweetmeat resting on the base element 14. The base element 14 has a transverse folding zone, comprising a centrally scored line 18, which divides it into two equal parts 14*a*, 14*b*. Each side of the first part 14*a* is provided with an upstanding side panel 16 which is perpendicular to the planar base element 14. A transparent plastics cap 20 has a lipped edge which rests on the base element 14 and encloses the sweetmeat 12, the side panels 16 being folded against the outside of the cap 20. A wrapper comprising a transparent, flexible, plastics envelope 22, encloses the entire package 10 and is sealed at each end.

Figure 5:
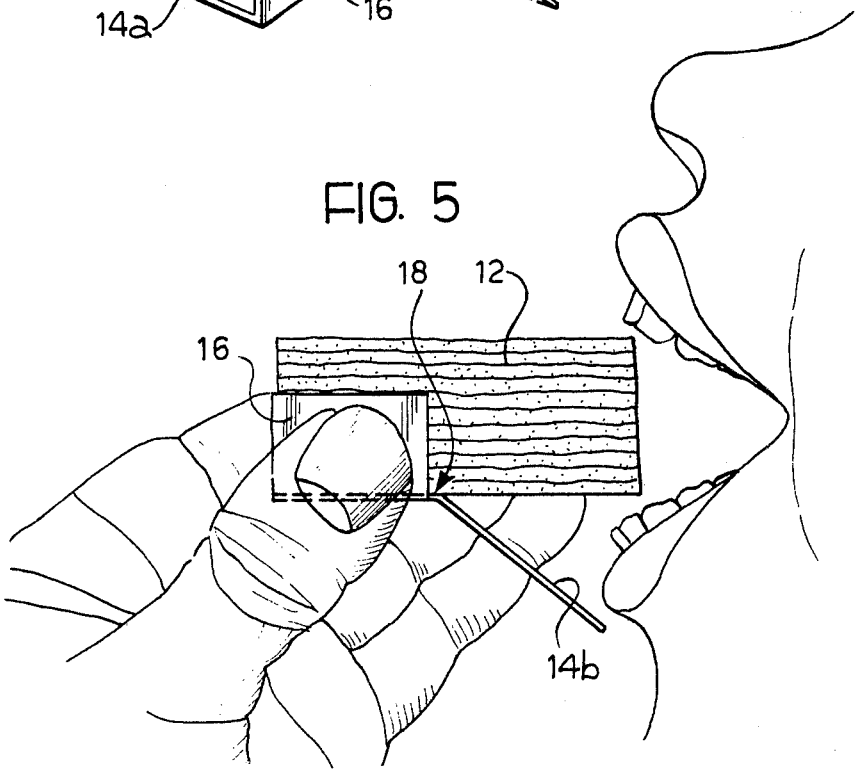
FIG. 5 shows the method of using the package during consumption of the product.

When the sweetmeat 12 is to be consumed, the wrapping envelope 22 is removed and, by holding the package 10 by the side panels 16, the cap 20 is lifted from the sweetmeat 12 which is retained on the base element 14 by squeezng the side panels 16 together. The use of the side panels 16 avoids direct contact between the fingers and the sweetmeat 12. The consumer then folds the second part 14*b* of the base element 14 downwards about the score line 18, away from the sweetmeat 12, as shown in FIG. 5, so as to leave one end of the sweetmeat projecting for easy consumption while the other end is held between the side panels 16.

The present package has the advantage of avoiding any direct contact between the consumer's fingers and the product; this is obviously beneficial as regards hygene, and is convenient, since the side panels prevent the consumer's hands from being soiled by a particularly sticky sweetmeat.

The transparent cap 20 allows the product to be seen, and, in the case of packages for larger products, may be re-used when a partly-consumed product is stored in, for example, a refrigerator.

What is claimed is:

1. A packaged sweetmeat comprising a sweetmeat product having a substantially planer base surface, a planar substantially rectangular base element upon which said planer base surface of said sweetmeat product rests, a pair of side panels connected to said base element along respective fold lines on opposite sides of said base element and extending from one end of said base element along a portion of the length thereof; a transverse fold line extending across said base element perpendicular to said side panels and adjacent the end of each of said side panels remote from said one end of said base element to divide the base element into a first part having side panels and a second part without side panels which is adapted to be fold downwardly away from said base of said sweetmeat product to facilitate its consumption, a plastic cap abutting said base element to completely enclose said sweetmeat product, each of said side panels being folded into an upstanding position relative to said base element abutting a respective outer surface of said cap and a flexible wrapper entirely closing said product and said base element.

2. A package as defined in claim 1, wherein said base element is made from cardboard.

3. A package as defined in claim 1, wherein said cap is transparent.

4. A package as defined in claim 1, wherein said wrapper is transparent.

5. A package as defined in claim 4, wherein said wrapper comprises a plastics envelope which is sealed at each end.

* * * * *